United States Patent [19]

Hinata et al.

[11] 4,308,345

[45] Dec. 29, 1981

[54] SILVER HALIDE PHOTOGRAPHIC EMULSION

[75] Inventors: Masanao Hinata; Haruo Takei; Akira Sato; Atsuo Iwamoto; Jun Hayashi, all of Kanagawa, Japan

[73] Assignee: Fuji Photo Film Co., Ltd., Minami-ashigara, Japan

[21] Appl. No.: 730,900

[22] Filed: Oct. 8, 1976

[30] Foreign Application Priority Data

Oct. 9, 1975 [JP] Japan ..... 50-122012

[51] Int. Cl.[3] ..... G03C 1/14

[52] U.S. Cl. ..... 430/574; 430/588

[58] Field of Search ..... 96/124, 137; 430/574, 430/588

[56] References Cited

U.S. PATENT DOCUMENTS

| | | | |
|---|---|---|---|
| 3,463,640 | 8/1969 | Ficken et al. | 96/124 |
| 3,922,170 | 11/1975 | Shiba et al. | 96/124 |
| 3,932,186 | 1/1976 | Borror et al. | 96/124 |

*Primary Examiner*—J. Travis Brown

*Attorney, Agent, or Firm*—Sughrue, Mion, Zinn, Macpeak and Seas

[57] ABSTRACT

A silver halide photographic emulsion selectively spectrally sensitized, particularly to red light, with a combination of at least one sensitizing dye represented by general formula (I):

(I)

wherein $Z^1$ and $Z^2$ each represents the atoms necessary to form a benzothiazole nucleus or a benzoselenazole nucleus, $R^1$ and $R^2$ *l each represents an alkyl group or a substituted alkyl group, wherein at least one of* $R^1$ or $R^2$ should represent a sulfo group-containing substituted alkyl group, a carboxyalkyl group or a hydroxyalkyl group, $R^3$ represents an alkyl group, $X_1$ represents an acid anion, and m represents 1 or 2, wherein m equals 1 when the dye forms an intramolecular salt (betaine-like structure); at least one sensitizing dye represented by general formula (II):

(II)

wherein $Z^3$ represents a sulfur atom or a selenium atom, $Z^4$ represents the atoms necessary to form a benzothiazole nucleus, a benzoselenazole nucleus, a naphtho[1,2-d]thiazole nucleus or a naphtho[1,2-d]selenazole nucleus, $R^4$ and $R^5$ each represents an alkyl group or a substituted alkyl group, wherein at least one of $R^4$ or $R^5$ should be a sulfo group-containing substituted alkyl group, a carboxyalkyl group or a hydroxyalkyl group, $R^6$ represents an alkyl group, an aryl group, a furyl group or a thienyl group, $X_2$ represents an acid anion, and n represents 1 or 2, wherein n equals 1 when the dye forms an intramolecular salt (betaine-like structure), and at least one benzimidazolothiacarbocyanine dye, which exhibits increased color reproducibility, high sensitivity and reduced residual coloration.

15 Claims, 2 Drawing Figures

SILVER HALIDE PHOTOGRAPHIC EMULSION

BACKGROUND OF THE INVENTION

1. Field of the Invention

The present invention relates to silver halide photographic emulsions which are spectrally sensitized, particularly, those which are fit to produce a red-sensitive emulsion layer of a multilayer color light sensitive material.

2. Description of the Prior Art

Spectral sensitization is an extremely important technique which has been used to not only impart a more appropriate sensitization distribution ranging from the intrinsic sensitization region to the longer wavelength region corresponding to green light and red light, but also to increase the total sensitivity (to white light). Particularly, since multilayer color photosensitive materials require respective photographic emulsion layers sensitive to not only blue light but also to green light and to red light, spectral sensitization is indispensable for the production of a green-sensitive emulsion layer and a red-sensitive emulsion layer.

Furthermore, it is required to impart a more suitable color reproducibility to color light sensitive materials. Therefore, the improvement in the characteristics of spectral sensitization in a green-sensitive layer and a red-sensitive layer becomes, from the standpoint of obtaining excellent color reproducibility, significant. In particular, it is important at what wavelength to make the red-sensitive layer selectively exhibit a sensitization maximum because the wavelength of the sensitization maximum of the red-sensitive layer delicately affects the reproducibility of skin color, which is a significant factor in color photographs, and also influences variations of color balance caused by changing the light source, as disclosed in Japanese Patent Publication 6207/74. For example, it is disclosed in Japanese Patent Publication 6207/74 that the selection of about 605 nm (±5 nm) as the wavelength of the sensitization maximum of the red-sensitive layer in a multilayer color light sensitive material is desirable to maintain the color balance under the best conditions when three kinds of illumination means are used, i.e., day light, a tungsten lamp and a fluorescent lamp. However, it is not preferred, for the purpose of producing highly sensitive color light sensitive materials employed for picture taking, to choose the above described wavelengths as the sensitization maximum of the red-sensitive emulsion layer because such a sensitization maximum will not impart high sensitivity to the color light sensitive material, though it can lead to the smallest variations in color balance with the kind of light sources used, and, therefore, it is necessary to render the grain size of silver halide in the photographic emulsion large to increase sensitivity, which results in a sacrifice of graininess and sharpness.

It was found that the conditions where the red-sensitive layer have a sensitization maximum within the wavelength region ranging from 625 nm to 645 nm and a spectral sensitivity corresponding to at least 40% of the maximum spectral sensitivity in the wavelength region ranging from 580 nm to 600 nm were the most advantageous conditions to obtain highly sensitive color light sensitive materials which possess a satisfactory high color reproducibility without harming graininess and sharpness. There are known many sensitizing dyes which show a sensitization maximum in the aforesaid wavelength region, but all of these known sensitizing dyes cannot impart a sufficiently high spectral sensitivity in the wavelength region ranging from 580 nm to 600 nm to photographic emulsions.

Moreover, it is required to take measures so that the spectral sensitization action inherent to a sensitizing dye is not inhibited by couplers which coexist therewith, since modern multilayer color light sensitive materials contain color image-forming couplers in the respective photographic emulsion layers. Furthermore, coloration caused by residual dye must not appear after photographic processings, since the hue of the color photograph obtained is remarkably impaired by such coloration.

SUMMARY OF THE INVENTION

Therefore, one object of the present invention is to provide a silver halide photographic emulsion highly sensitive to red light which is well suited to provide excellent color reproducibility to a red-sensitive layer in a highly sensitive color light sensitive material.

Another object of the present invention is to provide a spectrally sensitized silver halide photographic emulsion wherein a reduction in sensitivity resulting from the presence of a cyan color image-forming coupler is suppressed to a lesser extent.

A further object of the present invention is to provide a spectrally sensitized silver halide photographic emulsion which provides a red-sensitive emulsion layer developing less residual color after photographic processing.

The above described objects are attained with a silver halide photographic emulsion containing the combination of at least one sensitizing dye represented by the following general formula (I), at least one sensitizing dye represented by the following general formula (II) and at least one benzimidazolothiacarbocyanine dye:

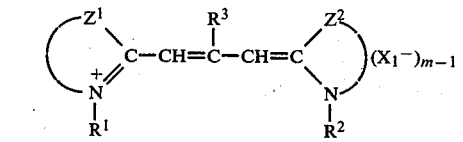

(I)

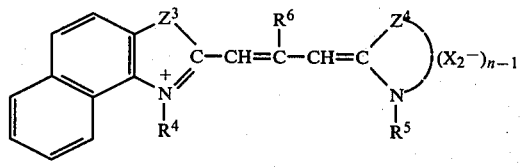

(II)

wherein $Z^1$ and $Z^2$ each represents the atoms necessary to form a benzothiazole nucleus or a benzoselenazole nucleus, $R^1$ and $R^2$ each represents an alkyl or a substituted alkyl group, wherein at least one of $R^1$ or $R^2$ should represent a sulfo group-containing substituted alkyl group, a carboxyalkyl group or a hydroxyalkyl group, where for these latter three groups the alkyl moiety most preferably contains from 2 to 4 carbon atoms, $R^3$ represents an alkyl group, $Z^3$ represents a sulfur atom or a selenium atom, $Z^4$ represents the atoms necessary to form a benzothiazole nucleus, a benzoselenazole nucleus, a naphtho[1,2-d]thiazole nucleus or a naphtho[1,2-d]selenazole nucleus, $R^4$ and $R^5$ each has the same meaning as $R^1$ and $R^2$, respectively, $R^6$ represents an alkyl group, most preferably an alkyl group as defined for $R^3$, an aryl group, e.g., phenyl, p-carboxyphenyl, m-carboxyphenyl, o-carboxyphenyl, etc., a furyl group or a thienyl group, $X_1$ and $X_2$ each represents an acid anion, and m and n each represents 1 or 2, wherein m and n equal 1 when the dye forms an intramolecular salt (betaine-like structure).

DETAILED DESCRIPTION OF THE INVENTION

Figure 1:
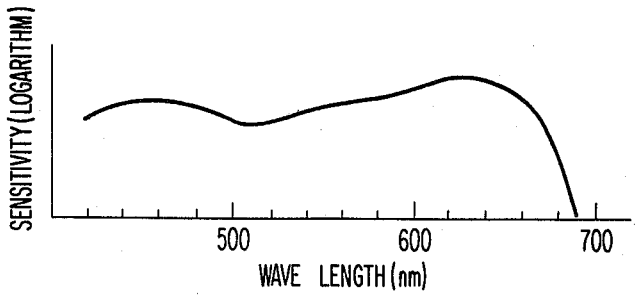
FIGS. 1 and 2 are spectrograms obtained when samples No. 4-1 and No. 13-2 prepared in Example 2 were tested, respectively.
Figure 2:
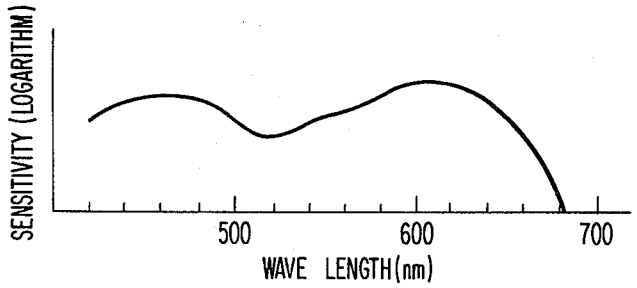

Specific examples of benzothiazole nuclei or benzoselenazole nuclei completed by each of $Z^1$, $Z^2$ and $Z^4$ include benzothiazole, 5-chlorobenzothiazole, 5-bromobenzothiazole, 5-methylbenzothiazole, 5-methoxybenzothiazole, 5-ethoxybenzothiazole, 6-methylbenzothiazole, 6-chlorobenzothiazole, 5-carboxybenzothiazole, 5-acetylbenzothiazole, 5-methoxycarbonylbenzothiazole, 5-hydroxybenzothiazole, 5-trifluoromethylbenzothiazole, 5-cyanobenzothiazole, 5,6-dimethylbenzothiazole, 5-acetylaminobenzothiazole, 6-methoxybenzothiazole, 5,6-dimethoxybenzothiazole, 5-ethoxy-6-methylbenzothiazole, 5,6-dichlorobenzothiazole, 5-hydroxy-6-methylbenzothiazole, 5-phenylbenzothiazole, benzoselenazole, 5-chlorobenzoselenazole, 5-bromobenzoselenazole, 5-methylbenzoselenazole, 5-methoxybenzoselenazole and 5,6-dimethylbenzoselenazole and the like.

Alkyl groups represented by $R^1$, $R^2$, $R^4$ and $R^5$ each preferably contain up to 8 carbon atoms, more preferably from 2 to 4 carbon atoms, and include a methyl group, an ethyl group, a propyl group and so on. Substituted alkyl groups represented by $R^1$, $R^2$, $R^4$ and $R^5$ have an alkyl moiety preferably containing up to 8 carbon atoms, more preferably from 2 to 4 to carbon atoms, wherein an oxygen atom may be present between carbon chains. Preferred examples of substituted alkyl groups include substituted alkyl groups containing a sulfo group such as a sulfoalkyl group (e.g., a 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl or the like), carboxyalkyl group (e.g., a 2-carboxyethyl group, 3-carboxypropyl group, 4-carboxybutyl group, carboxymethyl group or the like), hydroxyalkyl group (e.g., a 2-hydroxyethyl group, 3-hydroxypropyl group, 4-hydroxybutyl group or the like) and an allyl group.

$R^3$ represents an alkyl group containing up to 4 carbon atoms such as a methyl group, an ethyl group, a propyl group and so on.

$R^6$ represents a phenyl group, a furyl group, a thienyl group or an alkyl group such as defined for $R^3$.

Acid anions represented by $X_1$ and $X_2$ include acid anions as employed for preparing the common salts of cyanine dyes such as an iodine ion, a bromine ion, a chlorine ion, a p-toluene sulfonic acid ion, a benzene sulfonic acid ion, a sulfuric acid ion, a perchlorate ion, a rhodanine ion or the like.

Benzimidazolothiacarbocyanine dyes which are usefully employed in the practice of the present invention are represented by the following general formula (III):

(III)

-continued

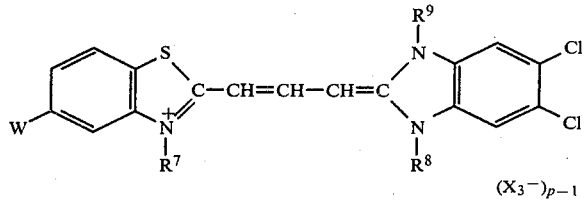

$(X_3^-)_{p-1}$ wherein $R^7$ and $R^8$ each represents an alkyl group, preferably an alkyl group having 1 to 8 carbon atoms, and most preferably 1 to 4 carbon atoms, or a substituted alkyl group, wherein the alkyl moiety preferably has 2 to 10 carbon atoms, most preferably 2 to 4 carbon atoms, and the substituent preferably is a sulfo group, a carboxy group or a hydroxy group, $R^9$ represents an alkyl group containing up to 4 carbon atoms, W represents a hydrogen atom, an alkyl group, an alkoxy group, a hydroxy group, a halogen atom or a phenyl group, $X_3$ represents an acid anion and p represents 1 or 2, wherein p equals 1 when the dye forms an intramolecular salt (betaine-like structure).

Specific examples of substituted groups represented by $R^7$ and $R^8$ include the same groups as represented by $R^1$ and $R^2$.

Specific examples of alkyl groups represented by $R^9$ include a methyl group, an ethyl group, a propyl group, a vinyl methyl group and so on.

Of groups represented by W, the alkyl group preferably contains up to 4 carbon atoms, most preferably 1 to 2 carbon atoms, for example, a methyl group, an ethyl group, a butyl group or the like, and the alkoxy group also preferably contains up to 4 carbon atoms, most preferably 1 to 2 carbon atoms, for example, a methoxy group, an ethoxy group, a butoxy group or the like. Specific examples of halogen atoms include a chlorine atom and a bromine atom.

Specific examples of $X_3$ include the same acid anions as represented by $X_1$ and $X_2$.

Sensitizing dyes which can be used to great advantage in the practice of the present invention and which are included in the above described general formulae (I), (II) or (III) have the respective following general formulae (I'), (II') or (III'):

(I')

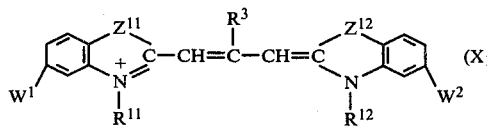

$(X_1^-)_{m-1}$ wherein $Z^{11}$ and $Z^{12}$ each represents a sulfur atom or a selenium atom, $W^1$ and $W^2$ each represents a hydrogen atom, a halogen atom, an alkyl group, preferably having 1 to 4 carbon atoms, most preferably 1 to 2 carbon atoms, an alkoxy group, preferably having 1 to 4 carbon atoms, most preferably 1 to 2 carbon atoms, a hydroxy group, a phenyl group, an acylamino group, wherein the acyl moiety preferably has 1 to 7 carbon atoms, most preferably 2 to 3 carbon atoms, an acyl group, preferably having 1 to 7 carbon atoms such as acetyl, propionyl, mesyl or benzoyl, most preferably 2 to 3 carbon atoms such as acetyl or propionyl, or an alkoxycarbonyl group, wherein the alkoxy moiety preferably has 1 to 6 carbon atoms, most preferably 1 to 3 carbon atoms, $R^{11}$ and $R^{12}$ each represents an alkyl group or substituted alkyl group as represented by $R^1$ and $R^2$, respectively, where at least one of $R^{11}$ and $R^{12}$ represents a sulfo group-containing substituted alkyl group, preferably having 2 to 8 carbon atoms, most preferably 2to 4 carbon atoms, and $R^3$, $X_1$ and m each has the same meaning as in the above described general formula (I);

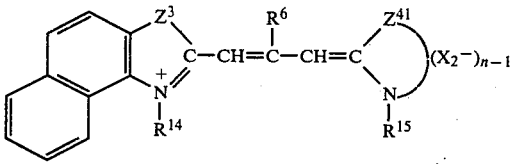

(II')

wherein $Z^3$ represents a sulfur atom or a selenium atom, $Z^{41}$ represents the atoms necessary to form a benzothiazole nucleus or a benzoselenazole nucleus which are each unsubstituted or either or both of which can be substituted with a halogen atom, an alkyl group, preferably having 1 to 4 carbon atoms, most preferably 1 to 2 carbon atoms, a hydroxy group or an alkoxy group, preferably having 1 to 4 carbon atoms, most preferably 1 to 2 carbon atoms, at the 5-position, a naphtho[1,2-d]thiazole nucleus or a naphtho[1,2-d]selenazole nucleus, $R^{14}$ and $R^{15}$ each represents an alkyl or substituted alkyl group as represented by $R^1$ or $R^2$, where at least one of $R^{14}$ and $R^{15}$ represents a sulfo group-containing substituted alkyl group, preferably having 2 to 8 carbon atoms, most preferably 2 to 4 carbon atoms, and $R^6$, $X_x$ and n each has the same meaning as in the above described general formula (II); and

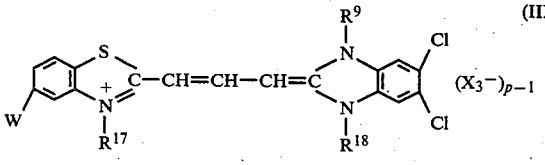

(III')

wherein $R^{17}$ and $R^{18}$ each represents an alkyl group or substituted alkyl group as represented by $R^1$ or $R^2$, where at least one of $R^{17}$ and $R^{18}$ represents a sulfo group-containing substituted alkyl group, and W, $R^9$, $X_3$ and p each has the same meaning as in the above described general formula (III).

Specific examples of the sensitizing dyes which can be employed in the practice of the present invention are illustrated below. However, the present invention is not to be interpreted as being limited to the dyes specifically described below.

Specific examples of dyes represented by general formula (I) include the following dyes.

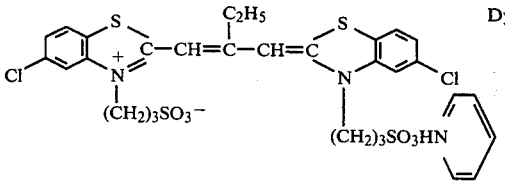

Dye (I-1)

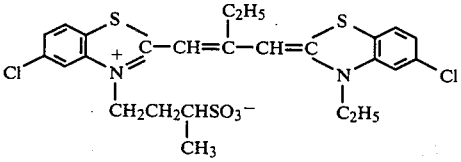

Dye (I-2)

-continued

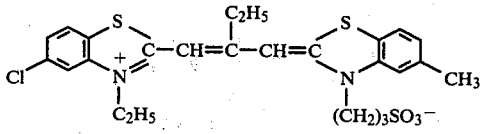

Dye (I-3)

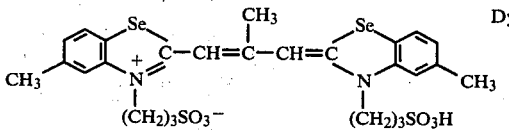

Dye (I-4)

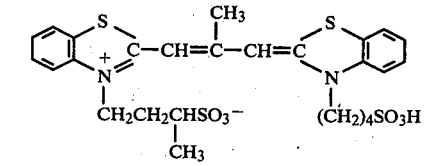

Dye (I-5)

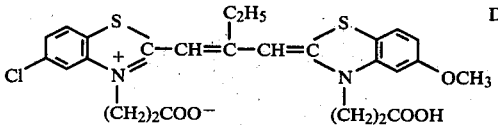

Dye (I-6)

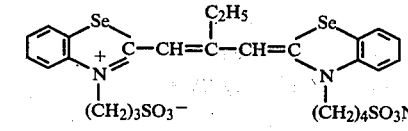

Dye (I-7)

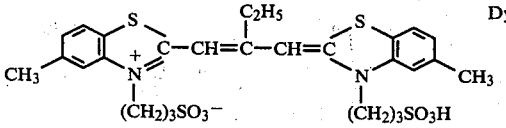

Dye (I-8)

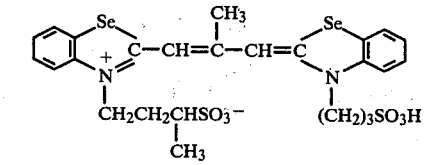

Dye (I-9)

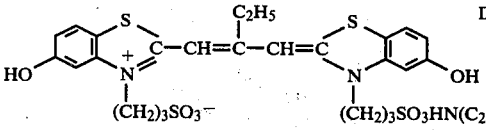

Dye (I-10)

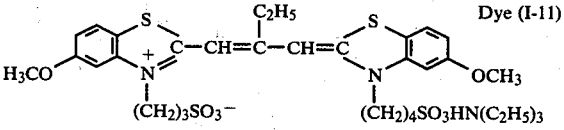

Dye (I-11)

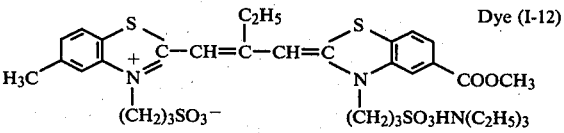

Dye (I-12)

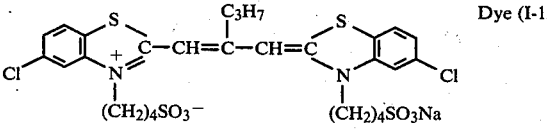

Dye (I-13)

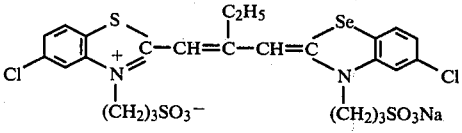

Dye (I-14)

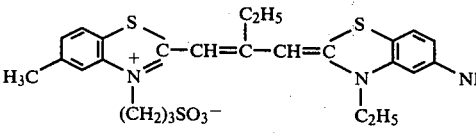

Dye (I-15)

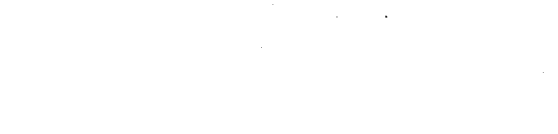

-continued
Dye (I-16)
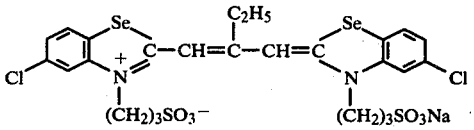
Dye (I-17)
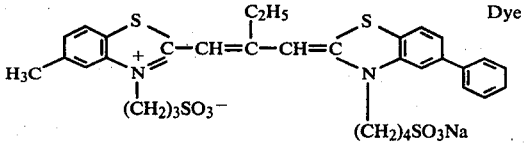
Dye (I-18)
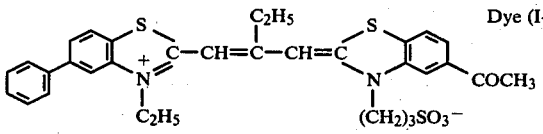
Dye (I-19)
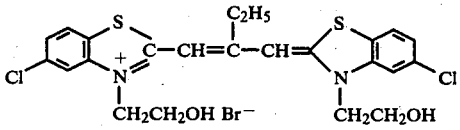
Specific examples of dyes represented by general formula (II) include the following dyes.
Dye (II-1)
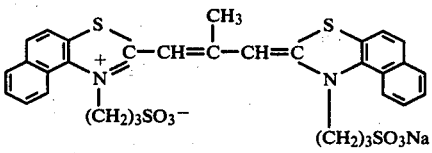
Dye (II-2)
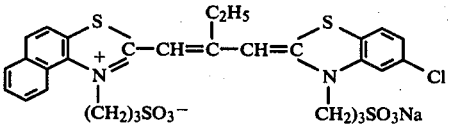
Dye (II-3)
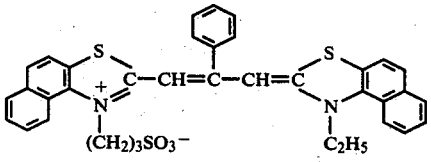
Dye (II-4)
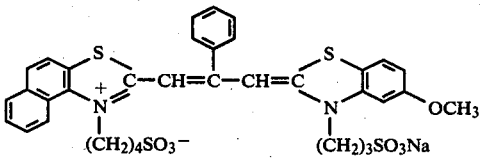
Dye (II-5)
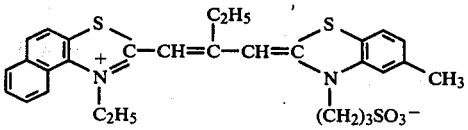
Dye (II-6)
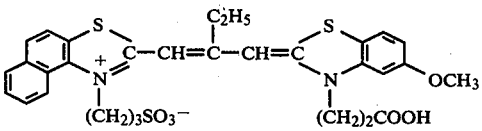
Dye (II-7)
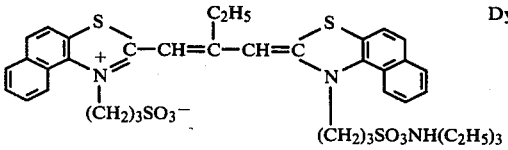
-continued
Dye (II-8)
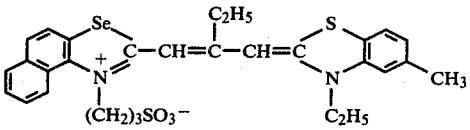
Dye (II-9)
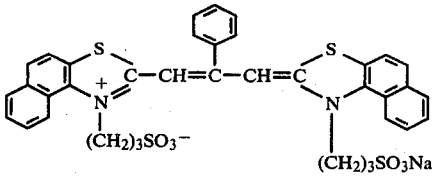
Dye (II-10)
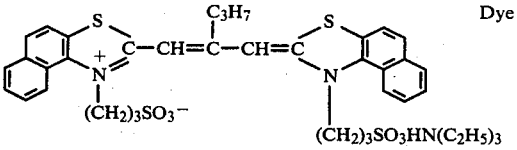
Dye (II-11)
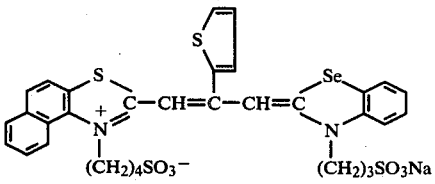
Dye (II-12)
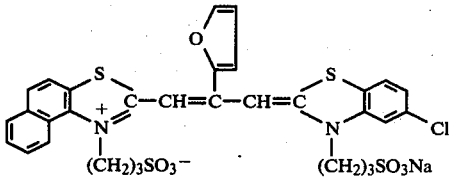
Dye (II-13)
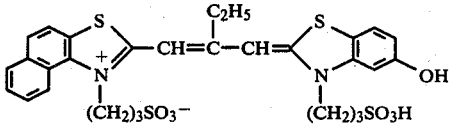
Dye (II-14)
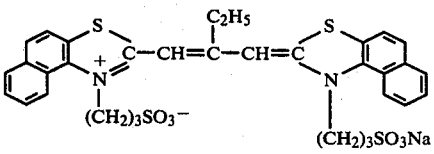
Specific examples of dyes represented by general formula (III) include the following dyes.
Dye (III-1)
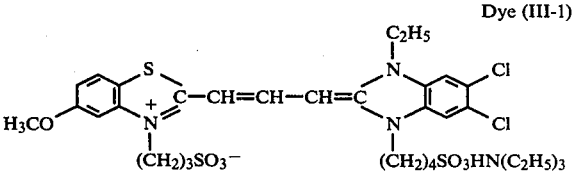
Dye (III-2)
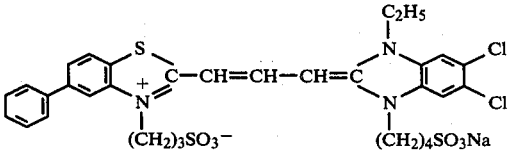

-continued

Dye (III-3)

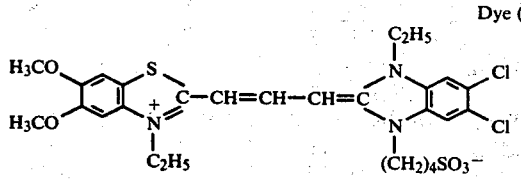

Dye (III-4)

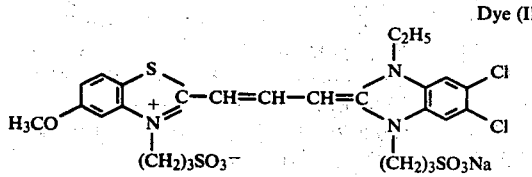

Dye (III-5)

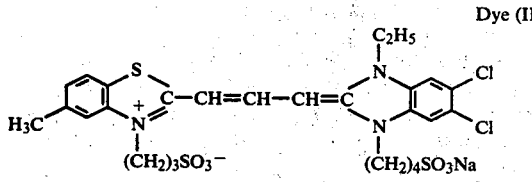

Dye (III-6)

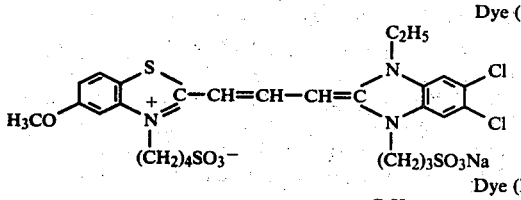

Dye (III-7)

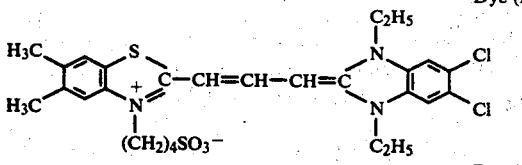

Dye (III-8)

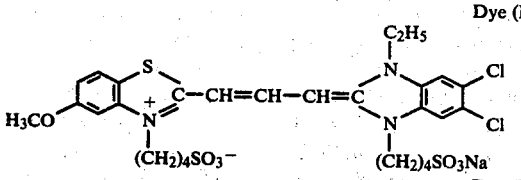

Dye (III-9)

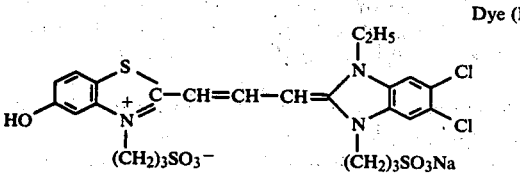

Dye (III-10)

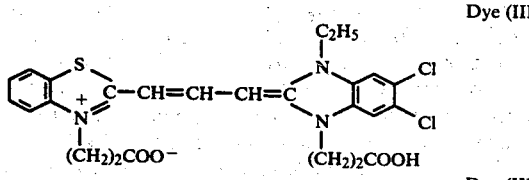

Dye (III-11)

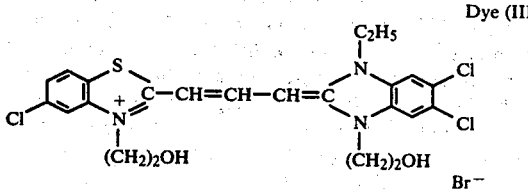

Especially preferred sensitizing dyes in the present invention are compounds represented by general formula (I') wherein $R^3$ is a methyl group and $W^1$ and $W^2$ each is a hydrogen atom, an alkyl group such as methyl or ethyl, an alkoxy group such as methoxy or ethoxy, or a halogen atom; the compounds represented by general formula (I') where $R^3$ is an ethyl group and $W^1$ and $W^2$ each is a hydrogen atom, a halogen atom, an alkyl group such as methyl or ethyl, an acyl group such as acetyl or propionyl or an alkoxy group such as methoxy or ethoxy; and compounds represented by general formula (II') where $Z^3$ is a sulfur atom, $Z^{41}$ forms a naphtho[1,2-d]thiazole nucleus and $R^6$ is a methyl group, an ethyl group or a phenyl group.

The compounds represented by general formulae (I), (II) and (III) each is incorporated into a silver halide photographic emulsion in an amount preferably ranging from about $1\times10^{-6}$ mol to about $5\times10^{-3}$ mol, particularly from $3\times10^{-6}$ mol to $2.5\times10^{-3}$ mol, and more particularly from $1\times10^{-5}$ mol to $1\times10^{-3}$ mol, per mol of silver halide (these ranges apply to the amounts of each class of dyes added). In addition, it is desirable, to attain the objects of the present invention, to choose the molar ratio among the amount of the dye represented by general formula (I), the amount of the dye represented by general formula (II) and the amount of the dye represented by general formula (III) so as to range from about 1~20:1: about 2~20.

Photographic emulsions which may be used in the practice of the present invention may additionally contain benzimidazolocarbocyanine dyes represented by the following general formula (IV):

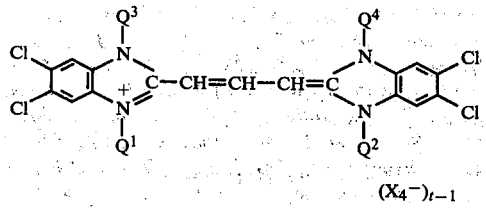

(IV)

wherein $Q^3$ represents an alkyl group, preferably having 1 to 4 carbon atoms, most preferably 1 to 3 carbon atoms, $Q^1$, $Q^2$ and $Q^4$ each represents an alkyl group or a substituted alkyl group (for example, an alkyl group or a substituted alkyl group as described for $R^1$ and $R^2$ in general formula (I), $X_4$ represents an acid anion, and t represents 1 or 2, wherein t equals 1 when the dye forms an intramolecular salt (betaine-like structure).

The amount of the dye(s) of general formula (IV) is preferably from about $1\times10^{-6}$ mol to about $5\times10^{-3}$ mol, particularly from $3\times10^{-6}$ mol to $2.5\times10^{-3}$ mol, and more particularly from about $1\times10^{-5}$ mol to about $1\times10^{-3}$ mol, per mol of silver halide, and the ratio of the dye(s) of general formula (IV) to the dye(s) of general formula (II) is preferably as follows (molar basis): dye(s) of general formula (IV)/dye(s) of general formula (II)=1 to 10/1.

Specific examples of dyes represented by general formula (IV) include the following dyes.

Dye (IV-1)

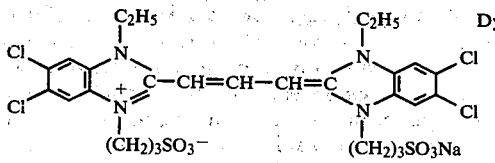

-continued

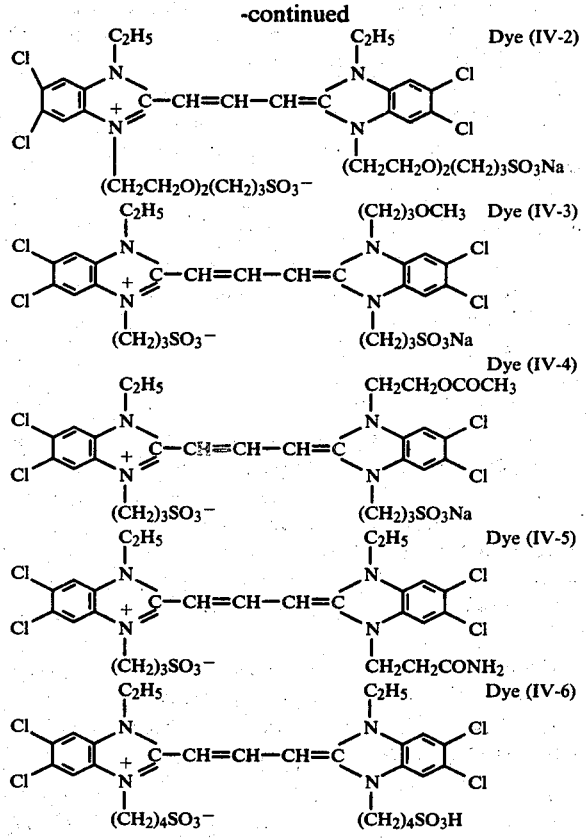

Methods for preparing the dyes defined by formulae (I) through (IV) are described, for example, in U.S. Pat. Nos. 2,503,776, 3,196,017, 3,177,210, 2,912,329, 3,632,349, 3,932,186 and British Pat. No. 1,138,395. See also Hamer, Frances M., *The Cyanine Dyes and Related Compounds,* Interscience Publishers, New York (1964) for many methods of preparation useful in preparing the above dyes. By appropriate selection of the necessary intermediates any of the individual dyes employed in this invention can be readily prepared by one of the methods set forth in the above.

All of silver bromide, silver iodobromide, silver iodochlorobromide, silver chlorobromide and silver chloride may be employed as the silver halide incorporated in a silver halide photographic emulsion of the present invention. The average grain size of silver halide grains incorporated in a photographic emulsion (the grain diameter is defined as the grain size when the grains are spherical in shape or have an analogous shape, and the length of a side is defined as the grain size when the grains are cubic in shape, and the grain size is expressed as the average measured by a projected area method) is preferably less than 3 microns, although it matters little whether it is small or not. The distribution of the grain size can be either narrow or wide.

The silver halide photographic emulsions which can be used in the present invention can be produced in a conventional manner as described in P. Glafkides, *Photographic Chemistry,* English Edition, Paul Montel, Paris (1958), and V. L. Zelikmanetal, *Making and Coating Photographic Emulsions,* The Focal Press, London and New York (1964). For example, a neutral method, acidic method or ammoniacal method can all be used. Either a single jet or double jet mixing method can be used for reacting a water soluble silver salt with a water soluble halogen salt to form the silver halide. Also, the method of forming grains in the presence of excess silver ion (called a reverse mixing method) can be employed. A method wherein the pAg value is kept constant in a liquid medium wherein the silver halide is being formed, that is, a controlled double jet method, can also be used as one form of simultaneous mixing method. According to this method, a silver halide emulsion possessing nearly a homogeneous crystal form and grain size can be produced. Two or more kinds of silver halide emulsions which are separately prepared may also be mixed and used, if desired.

Conventionally employed chemical sensitization techniques can also be used for photographic emulsions of the present invention. Namely, sulfur sensitization using compounds containing sulfur reactive with silver ions such as thiosulfates, allylisothiocyanate, organic compounds having an N-CS-NH- group (e.g., allylthiourea, triethylurea, etc.), rhodanines or active gelatin; reduction sensitization using reductive compounds such as polyamines, hydrazine derivatives, imino-aminomethane sulfinic acid, stannous salts, silane compounds and so on; gold sensitization using gold complex salts or gold thiosulfate complex salts as disclosed in U.S. Pat. No. 2,399,083; sensitization techniques using a Group VIII metal ion such as platinum, iridium, palladium, rhodium, ruthenium or the like as disclosed in U.S. Pat. No. 2,448,060; or a combination of these sensitization techniques.

The photosensitive emulsions of the present invention can contain a wide variety of compounds for preventing fogging or stabilizing the same during production, storage or processing of the sensitive material. Namely, azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles and the like; mercaptopyrimidines; mercaptotriazines; thioketo compounds; azaindenes such as triazaindenes, tetrazaindenes, pentazaindenes or the like; benzenethiosulfonic acids; benzenesulfonic acids; benzenesulfonic acid amides; and so on can be added.

The photosensitive emulsions of the present invention may contain organic or inorganic hardeners. Preferred organic hardeners include aldehyde compounds (e.g., formaldehyde, glyoxal and glutaraldehyde), N-methylol compounds (e.g., N,N'-dimethylol urea, methylol hydantoin and the like), dioxane derivatives (e.g., dihydroxydioxane or derivatives), epoxy group-containing compounds (e.g., 1,3-bis(2',3'-epoxypropoxy)-propane, or the like), active halogen-containing compounds (e.g., 2,4-dichloro-6-hydroxy-1,3,5-triazine or the like), mucohalogenic acids (e.g., mucochloric acid, mucobromic acid or derivatives thereof), bismethanesulfonic acid esters, sulfonyl compounds (e.g., bisbenzene sulfonyl chloride), divinyl sulfones, active olefin bond-containing compounds (e.g., divinyl ketones or acryloyl group-containing compounds or the like), aziridine compounds, alkylenebismaleimides, isocyanates, carbodiimides, dialdehyde starches and other macromolecular hardeners. Preferred inorganic hardeners include chrome salts (e.g., chrome alum, chrome acetate and the like), zirconium salts (e.g., zirconium sulfate) and so on. The aforesaid hardeners can be used individually or in combination. Precursors of hardeners, for example, addition products of bisulfites and aldehydes, methylol hydantoins and so on, can also be employed. Specific examples of these hardeners are disclosed in U.S. Pat. Nos. 1,870,354, 2,080,019, 2,574,801, 2,725,295, 2,726,162, 2,983,611, 2,992,109, 3,017,280, 3,047,394, 3,057,723, 3,103,437, 3,288,775, 3,325,287, 3,362,827 and 3,380,829, British Patents 676,628, 825,544, 994,869 and 1,167,207, German Pat. Nos. 872,153 and 1,090,427, Japanese Patent Publication Nos. 7133/59, 1872/71 and 38713/71, and so on.

The photographic emulsions which can be employed in the present invention may contain color image forming couplers, that is, compounds which react with the oxidation products of aromatic amine (generally primary amines) developing agents to result in the formation of dyes (abbreviated as couplers hereinafter).

It is desirable for these couplers to be non-diffusible by having a hydrophobic groups incorporated therein, generally called a ballast group, i.e., to have a structure which prevents diffusion thereof into other layers during production and color developing processing of the sensitive materials. Either four equivalent or two equivalent couplers may be used herein. Colored couplers which play a role in color correction or developing inhibitor-releasing couplers (DIR couplers) may also be employed.

Conventionally used open chain diketomethylene series couplers can be employed as yellow couplers. Of these couplers, benzolylacetoanilide series and pivaloylacetoanilide series compounds are used to advantage. Specific examples of yellow couplers which can be used in the present invention include the compounds disclosed in U.S. Pat. Nos. 2,875,057, 3,265,506, 3,341,331, 3,369,895, 3,408,194, 3,551,155, 3,582,322 and 3,725,072, German Patent Publication No. 1,547,868, German Patent Applications Nos. 2,057,941, 2,162,899, 2,213,461, 2,219,917, 2,261,361 and 2,263,875, and so on.

Pyrazolone compounds, indazolone compounds, cyanoacetyl compounds and the like can be employed as magenta couplers. Of these compounds, pyrazolone compounds are of greatest advantage. Specific examples of magenta couplers which can be employed in the present invention include compounds as disclosed in U.S. Pat. Nos. 2,439,098, 2,600,788, 2,983,608, 3,311,476, 3,419,391, 3,519,429, 3,558,319, 3,582,322 and 3,615,506, British Pat. No. 956,261, German Pat. No. 1,810,464, German Patent Applications Nos. 2,408,665, 2,418,959 and 2,424,467, Japanese Patent Publication No. 2016/69, and so on.

Phenol derivatives, naphthol derivatives and the like can be employed as cyan couplers. Specific examples are disclosed in U.S. Pat. Nos. 2,369,924, 2,434,272, 2,474,293, 2,600,788, 2,698,794, 2,706,684, 2,895,826, 3,034,892, 3,214,437, 3,253,924, 3,311,476, 3,386,830, 3,458,315, 3,560,212, 3,582,322, 3,583,971 and 3,591,383, German Patent Applications Nos. 2,163,811 and 2,414,006, Japanese Patent Publications Nos. 6031/65 and 28836/70, and so on.

Compounds as disclosed in, for example, Japanese Patent Publications Nos. 22335/63, 20591/66, 11304/67 and 32461/69, U.S. Pat. Nos. 3,034,892 and 3,386,830, and so on can also be used as colored couplers which provide cyan color images.

DIR couplers refer, in general, to compounds which contain a residue capable of forming a developing inhibitor as a group released on undergoing a coupling reaction, and the compounds as disclosed in, for example, U.S. Pat. Nos. 3,148,062, 3,227,554, 3,617,291, 3,622,328, 3,770,436 and 3,790,384, German Patent Application (OLS) No. 2,414,006, and so on can be employed as such DIR couplers.

In the sensitive material produced in accordance with the present invention, the hydrophilic colloid layers may contain compounds which are added to color sensitive materials for the purpose of the prevention of color fog or the prevention of color mixing between layers, and which include, for example, hydroquinones substituted which one or more alkyl groups, aryl groups, sulfo groups or the like, macromolecular compounds containing a hydroquinone residue, catechol derivatives, aminophenol derivatives, gallic acid derivatives, ascorbic acids and so on. These are incorporated therein in the form of dispersion when they are water insoluble. Specific examples of these compounds include the compounds disclosed in U.S. Pat. Nos. 2,336,327, 2,360,290, 2,384,658, 2,403,721, 2,728,659, 2,732,300, 2,735,765, 2,418,613, 2,675,314, 2,710,801, 2,816,028 and 2,360,290, French Pat. No. 885,982, and U.S. Pat. No. 3,457,079. These compounds can be incorporated in a hydrophilic colloid layer by dispersing them therein with the aid of an organic solvent possessing a high boiling point, such as aliphatic esters, aromatic carboxylic acid alkyl esters, aromatic phosphoric acid esters, aromatic ethers or the like, or by adding the same thereto in the form of an alkaline aqueous solution.

Exposure may be in a conventional manner. A wide variety of light sources including natural light (sunlight), a tungsten lamp, a fluorescent lamp, a mercury lamp, a xenon arc lamp, a carbon arc lamp, a xenon flash lamp, a cathode ray tube flying spot and the like can be used at exposure. Not only exposure times commonly used in taking a photographs with the average camera (ranging from 1/1,000 sec. to 1 sec.) but also exposure times shorter than 1/1,000 sec., for example, exposure times ranging from $1/10^4$ sec. to $1/10^6$ sec. achieved using a xenon flash lamp or a cathode ray tube display, and, further, exposure times longer than 1 sec. can be all applied to sensitive materials produced according to the present invention. The spectral composition of the light used for exposure can be optionally controlled by the use of color filters. Laser light can also be employed for exposure, if desired.

The sensitive materials of the present invention can be subjected to photographic treatments according to all known methods. Known processing solutions can be used, as desired. Processing temperature generally ranges from 18° C. to 50° C., but temperatures lower than 18° C. or higher than 50° C. can also be chosen for certain processings.

Either developing processing for forming silver images (processing for obtaining a black-and-white photograph) or developing processing for forming a dye image (processing for obtaining a color photograph) can be applied to the sensitive materials produced in accordance with the present invention.

A developing solution employed for obtaining a black-and-white photograph can contain known developing agents. As the developing agent, dihydroxybenzenes (e.g., hydroquinone, chlorohydroquinone, methylhydroquinone, etc.), 3-pyrazolidones (e.g., 1-phenyl-3-pyrazolidone, 1-phenyl-4-methyl-3-pyrazolidone, etc.), aminophenols (e.g., o-aminophenol, p-aminophenol, N-methyl-p-aminophenol, 2,4-diaminophenol, etc.), pyrogallol, ascorbic acid, 1-aryl-3-pyrazolines (e.g., 1-(p-hydroxyphenyl)-3-aminopyrazoline, etc.) or the like can be used individually or in combination. To the developing solution, preservatives (e.g., sulfites, bisulfites, ascorbic acids, etc.), alkali agents (hydroxides, carbonates, etc.), pH buffers (e.g., carbonates, borates, boric acid, acetic acid, citric acid, alkanolamines, etc.), dissolving aids (e.g., polyethylene glycols, esters thereof, alkanolamines, etc.), sensitizing agents (e.g., nonionic surface active agents containing polyoxyethylene chains, quaternary ammonium compounds, etc.), surface active agents, anti-foggants (e.g., halides such as potassium bromide and sodium bromide, nitroindazole, nitrobenzimidazole, benzotriazole, benzothiazole, tetrazoles, thiazoles, and so on), chelating agents (e.g., ethylenediamine tetraacetic acid or alkali metal salts thereof, nitrilotriacetates, polyphosphates, etc.), development accelerators (e.g., the compounds as disclosed in U.S. Pat. No. 2,304,025, Japanese Patent Publication No. 45541/72, and so on), hardeners (e.g., glutaraldehyde, etc.) or defoaming agents can be added.

The photographic emulsions produced in the present invention can be subjected to "lithographic type" processing, if desired, i.e., processing of the kind which is carried out under conditions using, in general, a dihydroxybenzene as a developing agent, a low concentration of sulfite ion, and allowing the individual developing processes to proceed in an infectious manner for the purpose of photographic reproduction of line images or halftone images using halftone dots is referred to as "lithographic type" processing (described in detail in L. F. A. Mason, *Photographic Processing Chemistry,* pp. 163~165 (1966)).

Fixing solutions as are conventionally used can be used in the present invention. A fixing solution is an aqueous solution usually consisting of a fixing agent, a hardener and optionally other components, and is commonly adjusted to have a pH of 3.8~5.0. Thiosulfates such as sodium thiosulfate, potassium thiosulfate, ammonium thiosulfate and the like, thiocyanates such as sodium thiocyanate, potassium thiocyanate, ammonium thiocyanate and the like, and certain organic sulfur compounds capable of producing water soluble, stable silver complex salts as are known as fixing agents can be employed as the fixing agent.

The fixing solution may contain as a hardener water soluble aluminum salts such as aluminum chloride, aluminum sulfate, potassium alum and the like.

Conventional procedures can be used to produce dye images in accordance with the present invention. For example, the negative-positive method as described in *Journal of the Society of Motion Picture and Television Engineers,* Vol. 61, pp. 667~701 (1953), the color reversal method comprising producing a negative silver image by developing with a developing solution containing a black-and-white developing agent and then a uniform exposure to light at least one time, or another appropriate fogging treatment, followed by dye coupling development to result in the formation of a positive dye image, and like methods may be employed.

Color developers are, in general, aqueous alkaline solutions containing color developing agents. Color developing agents which may be used in the present invention include well-known primary aromatic amine developers such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3-(β-methanesulfoamidoethyl)-N,N-diethylaniline, etc.) and so on. Examples of color developing agents are also described in L. F. A. Mason, *Photographic Processing Chemistry,* pp. 226~229, Focal Press (1966), and in various patents such as U.S. Pat. Nos. 2,193,015, and 2,592,364, and Japanese Patent Application (Laid-Open) 64933/73.

The color developing solution can contain conventionally used components such as an alkali metal salt of a sulfite, bisulfite, carbonate, bromide or iodide, pH buffer agents and so on, other than the developing agent. In addition, dye forming couplers, competitive couplers, anti-foggants, hardeners, antioxidants, viscosity increasing agents and so on may be optionally added to the color developing solution.

The photographic emulsion is bleached after the dye coupling development treatment. Bleaching and fixing may be carried out at the same time or separately. Specific examples of bleaching agents include compounds containing a polyvalent metal such as iron (III), cobalt (III), chromium (VI), copper (II) or the like (e.g., ferricyanates, bichromates, water soluble salts of cobalt (III) and water soluble salts of copper (II)) or complex salts of these metals and organic acids (e.g., complex salts of these metals and ethylenediamine tetraacetic acid, nitrilotriacetic acid, iminodiacetic acid, N-hydroxyethylethylenediamine triacetic acid or analogous aminopolycarboxylic acids, malonic acid, tartaric acid, malic acid, diglycolic acid, dithioglycolic acid and the like, and the complex salt of 2,6-dipicolinic acid and copper); peracids such as alkyl peracids, persulfates, permanganates and the like; hydrogen peroxide and analogous compounds; hypochlorites; water soluble quinones; nitrosophenols; and so on.

To such bleaching solutions, bleaching accelerating agents and various additives can also be added, as are described in U.S. Pat. Nos. 3,042,520 and 3,241,966, Japanese Patent Publications Nos. 8506/70 and 8836/70, and so on.

The present invention will now be illustrated in detail by the following examples.

The structural formulae of the dyes employed for comparison in the following examples are given below.

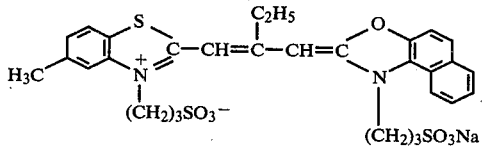

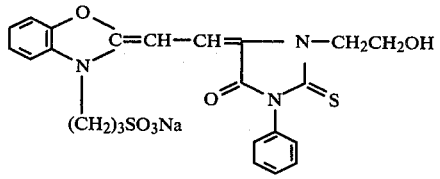

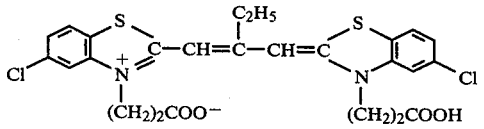

-continued

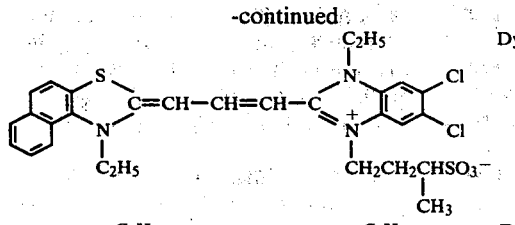

Dye (D)

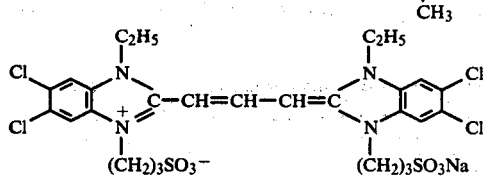

Dye (E)

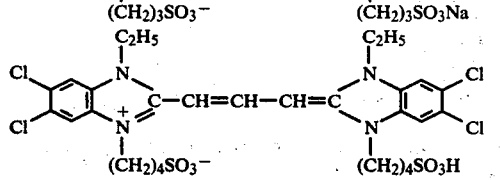

Dye (F)

EXAMPLE 1

Silver halide grains were precipitated by the single jet method, subjected to physical ripening in a conventional manner, desalted and chemically ripened. Thus, a silver iodobromide emulsion (iodide content: 8 mol%) was obtained. The silver halide grains contained in this emulsion had a mean diameter of 0.7 micron. This emulsion contained 0.52 mol of silver halide per Kg of the emulsion.

1 Kg portions of this emulsion were weighed out, which were then placed in a 50° C. thermostatic bath to melt the emulsion. Methanol solutions of the sensitizing dyes of the present invention were added to the emulsion portions in predetermined amounts as shown in Table 1, and mixed and stirred in a 40° C. thermostatic bath. To each emulsion portion were added 10 ml of a 1% by weight aqueous solution of 4-hydroxy-6-methyl-1,3,3a,7-tetrazaindene and 20 ml of a 1% by weight aqueous solution of 2-hydroxy-4,6-dichlorotriazine sodium salt, and the system stirred. Each of the thus finished emulsion portions was applied to a cellulose triacetate film support to give a dry thickness of 5 microns and then dried. Thus, samples of light-sensitive materials were obtained. Each of these film samples was cut into two strips. One of the strips was exposed wedgewise using a sensitometer containing a light source of a color temperature of 5,400° K., covered by a red filter (SC-56) manufactured by Fuji Photo Film Co., Ltd., or a blue filter (Wratten 47B) manufactured by Eastman Kodak Co. The intensity of illumination was 256 lux and the exposure time was 1/20 second.

The other strip was exposed for the purpose of obtaining a spectrogram using a diffraction grating type spectrographic camera containing a tungsten light source of a color temperature of 2,666° K.

The thus exposed strips were development processed at 20° C. for 7 minutes using a developer having the following composition, followed by stopping, fixing and washing.

| Composition of the Developer | |
|---|---|
| Water | 700 ml |
| Metol | 2 g |
| Sodium sulfite (anhydrous) | 100 g |
| Hydroquinone | 5 g |
| Borax (pentahydrate) | 1.5 g |
| Water to make | 1 l |

The density of these images was measured using a P-type densitometer (made by Fuji Photo Film Co., Ltd.). Thus, the red filter sensitivity ($S_R$), the blue filter sensitivity ($S_B$) and the filter-less white light sensitivity ($S_W$) were obtained. The standard point of the optical density to determine sensitivity was fog+0.20.

The results obtained are shown in Table 1.

TABLE 1

| Test No. | Dye and Amount Used × $10^{-5}$ Mol per Kg of Emulsion | | | | | | $S_R$* | $S_B$* | Fog | Remarks |
|---|---|---|---|---|---|---|---|---|---|---|
| 1-1 | | — | | — | | — | — | 100 | 0.04 | This |
| 2 | (I-2) | 4 | (II-7) | 0.5 | (III-3) | 8 | 160 | 96 | 0.04 | inven- |
| 3 | " | 4 | " | 1 | " | 8 | 176 | 96 | 0.04 | tion |
| 2-1 | (I-4) | 4 | (II-3) | 0.5 | (III-2) | 4 | 164 | 96 | 0.04 | This |
| 2 | " | 8 | " | 0.5 | " | 4 | 176 | 90 | 0.04 | inven- |
| | | | | | | | | | | tion |
| 3-1 | (I-4) | 4 | (II-1) | 1 | (III-1) | 8 | 178 | 96 | 0.04 | This |
| 2 | " | 8 | " | 1 | " | 8 | 184 | 90 | 0.04 | inven- |
| 3 | " | 8 | " | 2 | " | 4 | 184 | 90 | 0.04 | tion |
| 4-1 | (I-7) | 4 | (II-12) | 0.5 | (III-1) | 8 | 167 | 94 | 0.04 | This |
| 2 | " | 4 | " | 1 | " | 8 | 172 | 90 | 0.04 | inven- |
| | | | | | | | | | | tion |
| 5-1 | (I-9) | 8 | (II-2) | 1 | (III-1) | 8 | 160 | 92 | 0.04 | This |
| 2 | " | 8 | " | 2 | " | 8 | 164 | 88 | 0.04 | inven- |
| | | | | | | | | | | tion |
| 6-1 | (I-11) | 4 | (II-2) | 1 | (III-3) | 8 | 162 | 96 | 0.04 | This |
| 2 | " | 4 | " | 2 | " | 8 | 168 | 90 | 0.04 | inven- |
| | | | | | | | | | | tion |
| 7-1 | (I-2) | 8 | (II-4) | 1 | (III-1) | 8 | 167 | 94 | 0.04 | This |
| 2 | " | 8 | " | 2 | " | 8 | 172 | 90 | 0.04 | inven- |
| | | | | | | | | | | tion |
| 8-1 | (I-2) | 8 | (II-4) | 1 | | — | 140 | 96 | 0.04 | Compar- |
| 2 | " | 8 | " | 2 | | — | 146 | 92 | 0.04 | ison |
| 3 | " | 16 | " | 1 | | — | 130 | 72 | 0.06 | |
| 4 | " | 16 | " | 2 | | — | 130 | 67 | 0.06 | |
| 9-1 | (I-2) | 8 | | — | (III-1) | 8 | 130 | 96 | 0.04 | Compar- |
| 2 | " | 8 | | — | " | 16 | 118 | 58 | 0.06 | ison |
| 10-1 | (A) | 8 | (E) | 2 | | — | 100 | 96 | 0.04 | Compar- |
| 2 | " | 8 | " | 4 | | — | 94 | 96 | 0.04 | ison |

*Relative value

The value of sensitivity $S_R$ which was obtained in Test 10-1 in a conventional manner was taken as 100, and the value of the sensitivity $S_B$ which was obtained in Test 1-1 wherein no dyes were present was taken as 100. Therefore, they are represented by relative values. It can be seen from the comparison between Test 7 and Comparison 8 or 9, wherein some of the sensitizing dyes used in combination were excluded, that the present invention is of great advantage. The sensitive materials produced in accordance with the present invention demonstrate exceptionally high red sensitivity, compared with that of Test 10, wherein the combination of sensitizing dyes disclosed in Japanese Patent Application (Laid-Open) No. 87636/75 was used.

EXAMPLE 2

80 g of 1-hydroxy-N-[γ-(2,4-di-tert-amylphenoxypropyl)]-2-naphthamide was thoroughly dissolved in a mixed solution of 100 ml of tricresyl phosphate and 50 ml of ethyl acetate, to which 2 g of sorbitan monolaurate was added. The resulting solution was added to 1 kg of a 10% by weight aqueous solution of gelatin containing 2.5 g of dodecylbenzene sulfonic acid, stirred at high speed and then further stirred using ultrasonic waves. Emulsion #A was thus obtained.

1 kg portions of a silver iodobromide emulsion produced as in Example 1 were then separately weighed out and placed in a 50° C. thermostatic bath to melt the emulsion.

Methanol solutions of the sensitizing dyes of the present invention and sensitizing dyes for comparison were added to the emulsion portions in predetermined amounts as shown in Table 2, and the system mixed and stirred at 40° C., and allowed to stand for 15 minutes. To each emulsion portion were added 300 g of the above described Emulsion #A, 10 ml of a 1% by weight aqueous solution of 4-hydroxy-6-methyl-1,3,3a,7-tetrazaindene, 10 ml of a 1% by weight aqueous solution of 2-hydroxy-4,6-dichlorotriazine sodium salt and 10 ml of a 1% by weight aqueous solution of sodium dodecylbenzene sulfonate, and the mixture stirred.

Each of the thus finished emulsion portions was coated on a cellulose triacetate film support to provide a dry thickness of 5 microns and dried, and then a protective layer of gelatin was additionally applied thereto to provide a dry thickness of 1 micron and dried. Each of these film samples was cut into strips. One of the strips was wedge-wise exposed using the sensitometer described in Example 1, covered by a red filter (SC-56) made by Fuji Photo Film Co., Ltd. The intensity of illumination was 256 lux and the exposure time was 1/20 second. The other strip was exposed to obtain a spectrogram using the above described spectrographic camera. Further, a third strip was allowed to stand for 3 days at 50° C. and a relative humidity of 70% in order to investigate the property of keeping photographic characteristics in a stable fashion after the production of the sensitive materials. However, the photographic characteristics of the samples were scarcely affected by such storage.

These samples were development processed at 38° C. according to the following color negative processing formula:

| Process | Time |
|---|---|
| 1. Color development | 3 min. 15 sec. |
| 2. Bleaching | 6 min. 30 sec. |
| 3. Washing | 3 min. 15 sec. |
| 4. Fixing | 6 min. 30 sec. |
| 5. Washing | 3 min. 15 sec. |
| 6. Stabilizing | 3 min. 15 sec. |

The processing solutions used had the following compositions.

| | | |
|---|---|---|
| Color Developer | | |
| Sodium nitrilotriacetate | 1.0 | g |
| Sodium sulfite | 4.0 | g |
| Sodium carbonate | 30.0 | g |
| Potassium bromide | 1.4 | g |
| Hydroxyamine sulfate | 2.4 | g |
| 4-(N-ethyl-N-β-hydroxyethylamino)-2-methyl aniline sulfate | 4.5 | g |
| Water to make | 1 | l |
| Bleaching Solution | | |
| Ammonium bromide | 160.0 | g |
| Ammonia water (28 wt %) | 25.0 | ml |
| Sodium salt of (ethylenediaminetetraacetate)iron (III) | 130.0 | g |
| Glacial acetic acid | 14.0 | ml |
| Water to make | 1 | l |
| Fixing Solution | | |
| Sodium tetrapolyphosphate | 2.0 | g |
| Sodium sulfite | 4.0 | g |
| Ammonium thiosulfate (70 wt %) | 175.0 | ml |
| Sodium bisulfite | 4.6 | g |
| Water to make | 1 | l |
| Stabilizing Solution | | |
| Formalin (40 wt % formaldehyde) | 8.0 | ml |
| Water to make | 1 | l |

The thus obtained strips were subjected to density measurement using a P-type densitometer (made by Fuji Photo Film Co., Ltd.). The relative sensitivity and the fog density due to developed cyan color were determined. The standard point of the optical density to determine sensitivity was fog+0.20.

The results obtained are shown in Table 2, where the sensitivity is shown as a relative value.

TABLE 2

| Test No. | Dye and Amount Used × $10^{-5}$ Mol per Kg of Emulsion | | | | | | | $S_R$* | Cyan Fog | Remarks |
|---|---|---|---|---|---|---|---|---|---|---|
| 1-1 | | — | | — | | — | — | — | 0.07 | This |
| 2 | (I-1) | 2 | (II-7) | 1 | (III-6) | 8 | — | 130 | 0.07 | inven- |
| 3 | " | 4 | " | 1 | " | 8 | — | 137 | 0.07 | tion |
| 4 | " | 8 | " | 1 | " | 8 | — | 148 | 0.07 | |
| 2-1 | (I-1) | 4 | (II-7) | 1 | | — | — | 100 | 0.07 | Compar- |
| 2 | " | 8 | " | 1 | | — | — | 110 | 0.07 | ison |
| 3 | " | 16 | " | 1 | | — | — | 89 | 0.08 | |
| 3-1 | | — | (II-7) | 1 | (III-6) | 8 | — | 54 | 0.07 | Compar- |
| 2 | | — | " | 1 | " | 16 | — | 42 | 0.10 | ison |
| 4-1 | (I-1) | 4 | (II-7) | 1 | (III-1) | 6 | — | 140 | 0.07 | This |
| 2 | " | 8 | " | 1 | " | 6 | — | 153 | 0.07 | inven- |
| | | | | | | | | | | tion |
| 5-1 | (I-4) | 4 | (II-1) | 1 | (III-2) | 8 | — | 134 | 0.07 | This |

TABLE 2-continued

| Test No. | Dye and Amount Used × $10^{-5}$ Mol per Kg of Emulsion | | | | | | | | $S_R$* | Cyan Fog | Remarks |
|---|---|---|---|---|---|---|---|---|---|---|---|
| 2 | " | 8 | " | 1 | " | 8 | | — | 140 | 0.07 | invention |
| 6-1 | (I-9) | 4 | (II-1) | 1 | (III-4) | 8 | | — | 137 | 0.07 | This |
| 2 | " | 8 | " | 1 | " | 8 | | — | 156 | 0.07 | invention |
| 7-1 | (I-9) | 8 | (II-9) | 0.5 | (III-1) | 8 | | — | 153 | 0.07 | This |
| 2 | " | 8 | " | 1 | " | 8 | | — | 160 | 0.07 | invention |
| 8-1 | (I-1) | 8 | (II-3) | 0.5 | (III-4) | 6 | | — | 148 | 0.07 | This |
| 2 | " | 8 | " | 1 | " | 6 | | — | 160 | 0.07 | invention |
| 9-1 | (I-11) | 6 | (II-1) | 0.5 | (III-5) | 6 | | — | 130 | 0.07 | This |
| 2 | " | 6 | " | 1 | " | 6 | | — | 140 | 0.07 | invention |
| 10-1 | (I-2) | 8 | (II-6) | 0.5 | (III-1) | 6 | | — | 140 | 0.07 | This |
| 2 | " | 8 | " | 1 | " | 6 | | — | 148 | 0.07 | invention |
| 3 | " | 8 | " | 2 | " | 6 | | — | 160 | 0.07 | tion |
| 11-1 | (I-2) | 8 | (II-6) | 1 | | — | | — | 86 | 0.07 | Compar- |
| 2 | " | 16 | " | 1 | | — | | — | 78 | 0.08 | ison |
| 12-1 | | — | (II-6) | 1 | (III-1) | 6 | | — | 56 | 0.07 | Compar- |
| 2 | | — | " | 1 | " | 14 | | — | 53 | 0.08 | ison |
| 13-1 | (C) | 1 | (II-14) | 1 | (D) | 4.5 | (F) | 2.8 | 110 | 0.07 | Compar- |
| 2 | " | 2 | " | 2 | " | 9 | " | 5.6 | 116 | 0.07 | ison |

*Relative value

The value of the sensitivity $S_R$ which was obtained in Test 2-1 was taken as 100. Tests 2 and 3 correspond to the case wherein one of the dyes employed in Test 1 undertaken using the sensitive material produced in accordance with the present invention was excluded, and Tests 11 and 12 correspond to the case wherein one of the dyes employed in Test 10 undertaken in accordance with the present invention was excluded. Tests 1 and 10 which were carried out in accordance with the present invention showed exceptionally high red sensitivity, compared with comparative examples wherein only two kinds of sensitizing dyes were employed.

In addition, the combination of dyes disclosed in Japanese Patent Publication No. 6207/74 was used in Test 13. It can be seen from a comparison between Test 13 and the results of the present invention samples that the emulsions of the present invention exhibit excellent sensitivity to red light.

EXAMPLE 3

Onto cellulose triacetate film supports which had provided thereon a black colloidal silver-containing gelatin layer (silver content: 2 mg/100 cm², thickness: 1 micron) as an antihalation layer, the respective red-sensitive silver iodobromide emulsions containing the combinations of dyes shown in Table 3 was each coated at a coverage of 40 mg of silver per square centimeter and 6.8 mg of coupler per square centimeter.

Multilayer color sensitive materials were produced by further coating the following layers in turn thereon and drying after the application of each layer:

Colored Gelatin Layer

A gelatin layer containing poly-N,N-dimethylaminoethylmethacrylate (molecular weight: about 70,000) and bis[1-(p-sulfophenyl)-3-butyl-pyrazole-5-one]trimethineoxonol (1micron dry thickness.

Green-sensitive Emulsion Layer

A layer of green-sensitive silver iodobromide emulsion spectrally sensitized with an oxacarbocyanine and a benzimidazolocarbocyanine, and containing as a color image forming coupler 1-(2,4,6-trichlorophenyl)-3-[3-(2,4-di-t-amylphenoxyacetamide)benzamide]-5-pyrazolone in the form of dispersion. Silver content: 35 mg/100 cm²; and coupler content: 5.3 mg/100 cm².

Yellow Filter Layer

A gelatin layer containing yellow colloidal silver and 2,5-di-(2,4,4-trimethylpentyl)-2)-hydroquinone in the form of a dispersion dispersed in a tricresyl phosphate solution. Silver content: 1 mg/100 cm².

Blue-sensitive Emulsion Layer

A layer containing as a yellow coupler α-pivaloyl-α-(2,4-dioxo-5,5'-dimethyl-3-oxazolidinyl)-2-chloro-5-[α-(2,4-di-tert-amylphenoxy)butylamide]acetoanilide in a gelatin silver iodobromide emulsion. Silver content: 20 mg/100 cm². Coupler content: 8 mg/100 cm².

Protective Layer

A layer containing gelatin (dry thickness: 1 micron).

Dodecylbenzene sulfonic acid sodium salt as a coating aid, and 2,4-dichloro-6-hydroxy-1,3,5-triazine sodium salt as a hardener were added to each layer before coating. The thus obtained samples were each wedgewise exposed and developed as in Example 2. The results obtained are shown in Table 3.

TABLE 3

| Test No. | Dye and Amount Used × $10^{-5}$ Mol per Kg of Emulsion | | | | | | $S_R$* | Cyan Fog |
|---|---|---|---|---|---|---|---|---|
| 1-1 | | — | | — | | — | — | 0.16 |
| 2 | (I-1) | 4 | (II-7) | 1 | (III-6) | 8 | 115 | 0.16 |
| 3 | " | 8 | " | 1 | " | 8 | 124 | 0.16 |
| 2-1 | (I-9) | 8 | (II-9) | 0.5 | (III-1) | 8 | 128 | 0.16 |
| 2 | " | 8 | " | 1 | " | 8 | 132 | 0.16 |
| 3-1 | (I-1) | 8 | (II-3) | 1 | (III-4) | 6 | 128 | 0.16 |
| 2 | " | 12 | " | 1 | " | 6 | 136 | 0.16 |
| 4-1 | (I-1) | 12 | (II-7) | 1 | (III-1) | 3 | 130 | 0.16 |
| 5-1 | (I-1) | 8 | (II-7) | 1 | | — | 100 | 0.16 |
| 2 | " | 16 | " | 1 | | — | 82 | 0.17 |
| 6-1 | | — | (II-7) | 1 | (III-6) | 8 | 39 | 0.16 |
| 2 | | — | " | 1 | " | 16 | 33 | 0.18 |

*Relative value

The value of the sensitivity $S_R$ is a relative value, with the value obtained in Test 5-1 as 100. Tests 5 and 6 involve conventional techniques since each sample used therein had a composition lacking one dye present in each sample used in Test 1. It can be seen from a comparison of Tests 5 or 6 and Test 1 (according to the present invention) that the combination of dyes employed in the present invention provides high red sensitivity.

EXAMPLE 4

Silver halide grains were precipitated using a double jet method, subjected to physical ripening in a conventional manner, desalted and chemically ripened. Thus, a silver chloroiodobromide emulsion (iodide content: 0.3 mol%, bromide content: 16.5 mol%) was obtained. The silver halide grains contained in this emulsion had a mean diameter of 0.4 micron. This emulsion contained 1.15 mol of silver halide per Kg of the emulsion 1 Kg portions of this emulsion were weighed out, and placed in a 50° C. thermostatic bath to melt the emulsion. Methanol solutions of the sensitizing dyes of the present invention were added to the emulsion portions in predetermined amounts as shown in Table 4, and the system mixed and stirred in a 40° C. thermostatic bath. To each emulsion portion were added 20 ml of a 1% by weight aqueous solution of 4-hydroxy-6-methyl-1,3,3a,7-tetrazaindene, 10 ml of a 1% by weight aqueous solution of 2-hydroxy-4,6-dichlorotriazine sodium salt and further 10 ml of a 1% by weight aqueous solution of sodium dodecylbenzene sulfonate, and the system stirred. Each of the thus finished emulsion portions was applied to a cellulose triacetate film support to provide a dry thickness of 5 microns and then dried. The thus obtained film samples of light sensitive materials were each cut into strips. One of the strips was wedge-wise exposed using the same sensitometer as used in Example 1, covered by a red filter (Wratten 25) or a blue filter (Wratten 47B) made by Eastman Kodak Co. The intensity of illumination was 256 lux and the exposure time was 1/5 second.

The other strip was exposed for the purpose of obtaining a spectrogram using the same diffraction grating type spectrographic camera as was used in Example 1.

The thus exposed strips were development processed at 20° C. for 2 minutes using a developer having the following composition, followed by stopping, fixing and washing.

| Composition of the Developer | |
|---|---|
| Metol | 2 g |
| Sodium sulfite (anhydrous) | 40 g |
| Hydroquinone | 4 g |
| Sodium carbonate (monohydrate) | 28 g |
| Potassium bromide | 1 g |
| Water to make | 1 l |

Upon use, an equal volume of water was added to the developer.

The density of the resulting images was measured using a P-type densitometer as described above. The red filter sensitivity ($S_R$) and the blue filter sensitivity ($S_B$) were thus obtained. The standard point of the optical density to determine sensitivity was fog+0.20.

The results obtained are shown in Table 4.

TABLE 4

| Test No. | Dye and Amount Used × $10^{-5}$ Mol per Kg of Emulsion | | | | | | | | $S_R$* | $S_B$* | Fog |
|---|---|---|---|---|---|---|---|---|---|---|---|
| 1-1 | | — | | — | | — | | — | — | 100 | 0.04 |
| 2 | (I-1) | 4 | (II-7) | 6 | (III-8) | 16 | | — | 163 | 100 | 0.04 |
| 3 | " | 8 | " | 6 | " | 16 | | — | 175 | 106 | 0.04 |
| 2-1 | (I-1) | 12 | (II-1) | 4 | (III-8) | 16 | | — | 182 | 100 | 0.04 |
| 2 | " | 12 | " | 8 | " | 16 | | — | 190 | 106 | 0.04 |
| 3-1 | (I-1) | 12 | (II-7) | 3 | (III-3) | 16 | | — | 190 | 100 | 0.04 |
| 2 | " | 12 | " | 6 | " | 16 | | — | 195 | 110 | 0.04 |
| 4-1 | (I-9) | 6 | (II-7) | 3 | (III-5) | 12 | | — | 160 | 100 | 0.04 |
| 2 | " | 12 | " | 3 | " | 12 | | — | 167 | 96 | 0.04 |
| 5-1 | (I-4) | 6 | (II-7) | 3 | (III-4) | 12 | | — | 175 | 106 | 0.04 |
| 2 | " | 12 | " | 3 | " | 12 | | — | 182 | 106 | 0.04 |
| 6-1 | | — | (II-7) | 8 | | — | (B) | 8 | 100 | 115 | 0.04 |
| 2 | | — | " | 8 | | — | " | 16 | 100 | 128 | 0.04 |
| 3 | | — | " | 8 | | — | " | 32 | 95 | 148 | 0.05 |
| 7-1 | (I-1) | 12 | (II-7) | 6 | | — | | — | 130 | 100 | 0.04 |
| 2 | " | 24 | " | 6 | | — | | — | 106 | 88 | 0.06 |
| 8-1 | | — | (II-7) | 6 | (III-8) | 16 | | — | 83 | 100 | 0.04 |
| 2 | | — | " | 6 | " | 24 | | — | 68 | 82 | 0.06 |

*Relative value

The value of the sensitivity $S_R$ which was obtained in Test 6-1 was taken as 100. The combination of dyes employed in Test 6 is a well-known, representative prior art combination, as disclosed in U.S. Pat. No. 3,808,009. The combinations of dyes employed in Tests 7 and 8 involve known techniques since one of dyes in the composition of Test 1 was excluded. It can be seen from the above described results, and comparison between the results obtained in Tests 7 or 8 and Test 1, that the combination of three kinds of dyes of the present invention provides exceptionally high red sensitivity and is of great advantage, as compared with conventional techniques.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion spectrally sensitized with a combination of at least one sensitizing dye represented by the following general formula (I):

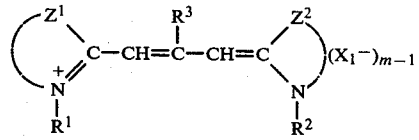

(I)

wherein $Z^1$ and $Z^2$ each represents the atoms necessary to form a benzothiazole nucleus or a benzoselenazole nucleus, $R^1$ and $R^2$ each represents an alkyl group or a substituted alkyl group wherein at least one of $R^1$ or $R^2$ represents a sulfo group-containing substituted alkyl group, a carboxyalkyl group or a hydroxyalkyl group, $R^3$ represents an alkyl group, $X^1$ represents an acid anion, and m represents 1 or 2, wherein m equals 1 when the dye forms an intramolecular salt (betaine-like structure); at least one sensitizing dye represented by the following general formula (II):

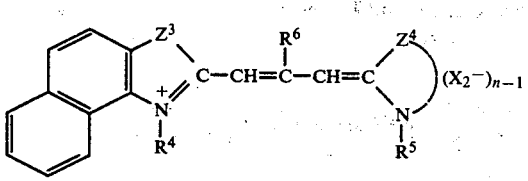

(II)

wherein $Z^3$ represents a sulfur atom or a selenium atom, $Z^4$ represents the atoms necessary to form a benzothiazole nucleus, a benzoselenazole nucleus, a naphthol[1,2-d]thiazole nucleus or a naphtho[1,2-d]selenazole nucleus, $R^4$ and $R^5$ each represents an alkyl group or a substituted alkyl group, wherein at least one of $R^4$ or $R^5$ is a sulfo group-containing substituted alkyl group, a carboxyalkyl group or a hydroxyalkyl group, $R^6$ represents an alkyl group, an aryl group, a furyl group or a thienyl group, $X^2$ represents an acid anion, and n represents 1 or 2, wherein n equals 1 when the dye forms an intramolecular salt (betaine-like structure); and at least one benzimidazolothiacarbocyanine dye represented by the following general formula (III):

(III)

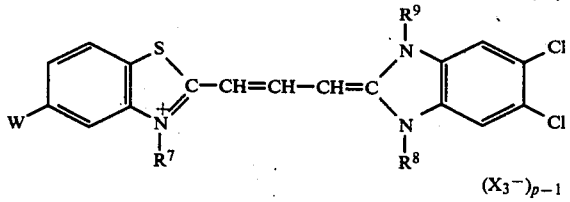

wherein $R^7$ and $R^8$ each represents an alkyl group or a substituted alkyl group, $R^9$ represents an alkyl group containing up to 4 carbon atoms, W represents a hydrogen atom, an alkyl group, an alkoxy group, a hydroxy group, a halogen atom or a phenyl group, $X_3$ represents an acid anion and p represents 1 or 2, wherein p equals 1 when the dye forms an intramolecular salt (betaine-like structure).

2. The silver halide photographic emulsion as described in claim 1, wherein said three kinds of sensitizing dyes which are each represented by general formulae (I), (II) and (III) are represented by general formulae (I'), (II') and (III'), respectively:

(I')

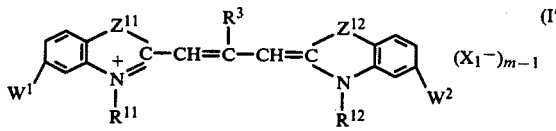

wherein $Z^{11}$ and $Z^{12}$ each represents a sulfur atom or a selenium atom, $W^1$ and $W^2$ each represents a hydrogen atom, a halogen atom, an alkyl group having 1 to 4 carbon atoms, an alkoxy group having 1 to 4 carbon atoms, a hydroxy group, a phenyl group, an acylamino group, wherein the acyl moiety has 1 to 7 carbon atoms, an acyl group having 1 to 7 carbon atoms, or an alkoxycarbonyl group, wherein the alkoxy moiety has 1 to 6 carbon atoms, $R^{11}$ and $R^{12}$ each represents an alkyl group or substituted alkyl group as represented by $R^1$ and $R^2$, respectively, where at least one of $R^{11}$ and $R^{12}$ represents a sulfo group-containing substituted alkyl group, having 2 to 8 carbon atoms, and $R^3$, $X_1$ and m each has the same meaning as in the above described general formula (I);

(II')

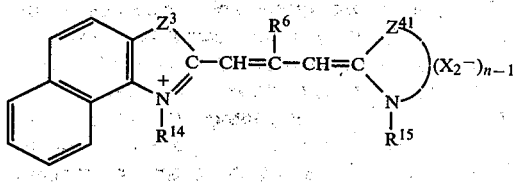

wherein $Z^3$ represents a sulfur atom or a selenium atom, $Z^{41}$ represents the atoms necessary to form a benzothiazole nucleus or a benzoselenazole nucleus which are each unsubstituted or either or both of which can be substituted with a halogen atom, an alkyl group having 1 to 4 carbon atoms, a hydroxy group or an alkoxy group having 1 to 4 carbon atoms, at the 5-position, a naphtho[1,2-d]thiazole nucleus or a naphtho[1,2-d]selenazole nucleus, $R^{14}$ and $R^{15}$ each represents an alkyl or substituted alkyl group as represented by $R^1$ or $R^2$, where at least one of $R^{14}$ and $R^{15}$ represents a sulfo group containing substituted alkyl group having 2 to 8 carbon atoms, and $R^6$, $X_2$ and n each has the same meaning as in the above described general formula (II); and (III')

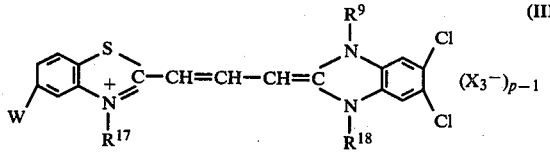

wherein $R^{17}$ and $R^{18}$ each represents an alkyl group or substituted alkyl group as represented by $R^1$ or $R^2$, where at least one of $R^{17}$ and $R^{18}$ represents a sulfo group-containing substituted alkyl group, and W, $R^9$, $X_3$ and p each has the same meaning as in the above described general formula (III).

3. The silver halide photographic emulsion as described in claim 2, wherein $R^3$ in general formula (I') representing one of said sensitizing dyes is a methyl group, and $Z^{11}$ and $Z^{12}$ each is a benzoselenazole nucleus which is unsubstituted or substituted by an alkyl group or an alkoxy group at the 5- and 5'-positions, respectively.

4. The silver halide photographic emulsion as described in claim 2, wherein $R^3$ in general formula (I') is an ethyl group, and $Z^{11}$ and $Z^{12}$ are benzothiazole nuclei or benzoselenazole nuclei which are unsubstituted or substituted by alkyl groups, hydroxy groups, or halogen atoms at the 5- and 5'-positions thereof.

5. The silver halide photographic emulsion as described in claim 2, wherein $R^6$ in general formula (II') is a methyl group, an ethyl group, or a phenyl group.

6. The silver halide photographic emulsion as described in claim 2, wherein $R^6$ in general formula (II') is a thienyl group or a furyl group.

7. The silver halide photographic emulsion as described in claim 2, wherein W in general formula (III') is an alkyl group or an alkoxy group.

8. The silver halide photographic emulsion as described in claim 2, wherein at least one of $R^{11}$ or $R^{12}$ in general formula (I') is a sulfoalkyl group.

9. The silver halide photographic emulsion as described in claim 2, wherein at least one of $R^{14}$ or $R^{15}$ in general formula (II') is a sulfoalkyl group.

10. The silver halide photographic emulsion as described in claim 2, wherein at least one of $R^{17}$ or $R^{18}$ in general formula (III') is a sulfoalkyl group.

11. The silver halide photographic emulsion as described in claim 2, wherein the molar ratio among the amounts of the dyes represented by general formulae (I'), (II') and (III'), respectively is 2~20:1:2~20.

12. A silver iodobromide photographic emulsion as described in claim 11, wherein the dye represented by general formula (II') is added in an amount ranging from about $1\times10^{-6}$ mol to about $5.0\times10^{-3}$ mol per mol of silver halide.

13. A silver chloroiodobromide photographic emulsion as described in claim 11, wherein the dye represented by general formula (II') is added in an amount ranging from about $1\times10^{-5}$ mol to about $1\times10^{-3}$ mol per mol of silver halide.

14. The silver halide photographic emulsion as described in claim 9, wherein $R^{14}$ and $R^{15}$ each represents a 3-sulfopropyl group.

15. A photographic silver halide emulsion spectrally sensitized with a sensitizing combination of at least one sensitizing dye represented by formula (I), at least one sensitizing dye represented by formula (II), and at least one sensitizing dye represented by formula (III):

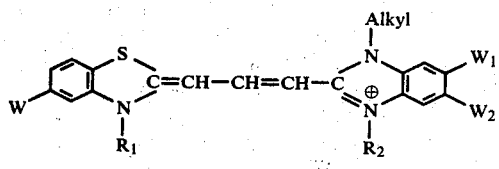

(I)

wherein W is hydrogen, halogen or alkoxy; $W_1$ and $W_2$ is each halogen; and $R_1$ and $R_2$ is each sulfo or carboxy-substituted alkyl;

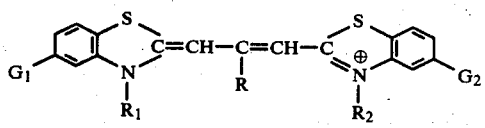

(II)

wherein R is alkyl; $G_1$ and $G_2$ is each halogen, alkyl, aryl or alkoxy; and $R_1$ and $R_2$ is each sulfo or carboxy-substituted alkyl;

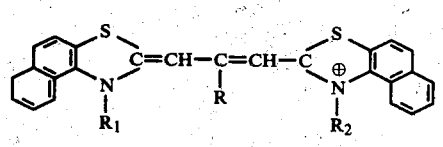

(III)

wherein R is alkyl and $R_1$ and $R_2$ is each sulfo or carboxy-substituted alkyl.

* * * * *